United States Patent [19]

Quittner

[11] Patent Number: 4,624,601

[45] **Date of Patent: * Nov. 25, 1986**

[54] TRANSFERABLE ROADWAY LANE DIVIDER

[75] Inventor: John P. Quittner, Castle Cove, Australia

[73] Assignee: Quick-Steel Engineering Pty Limited, New South Wales, Australia

[ * ] Notice: The portion of the term of this patent subsequent to Feb. 19, 2002 has been disclaimed.

[21] Appl. No.: 633,236

[22] Filed: Jul. 23, 1984

Related U.S. Application Data

[63] Continuation of Ser. No. 344,755, Feb. 1, 1982, abandoned.

[30] Foreign Application Priority Data

Feb. 6, 1981 [AU] Australia ..... PE7491

[51] Int. Cl.[4] ..... E01F 13/00; E01C 23/16

[52] U.S. Cl. ..... 404/12; 404/6; 404/13; 404/72; 404/83; 414/529; 104/4

[58] Field of Search ..... 404/6, 9, 12–14, 404/71, 83, 72, 73; 116/63 R, 63 P; 40/612; 104/4; 414/529, 787; 198/309, 864; 193/35 R

[56] References Cited

U.S. PATENT DOCUMENTS

| | | | |
|---|---|---|---|
| 1,683,121 | 9/1928 | Baldwin | 404/13 |
| 1,726,267 | 8/1929 | Higgins | 404/13 |
| 2,841,059 | 7/1958 | Wiswell | 404/13 |
| 2,851,935 | 9/1958 | Weeks | 404/13 |
| 2,931,279 | 4/1960 | Wiswell | 404/13 X |
| 3,245,327 | 4/1966 | Wasley | 404/12 |
| 3,263,578 | 8/1966 | Pilcher | 404/13 |
| 3,326,099 | 6/1967 | Cova et al. | 404/7 |
| 3,636,691 | 1/1972 | O'Brien | 116/114 R |
| 3,958,890 | 5/1976 | Ferrari | 404/72 X |
| 3,980,279 | 9/1976 | Bofinger | 256/13.1 |
| 4,004,857 | 1/1977 | Eschen, Jr. | 404/6 |
| 4,017,200 | 4/1977 | Woods, Jr. | 404/12 X |
| 4,139,087 | 2/1979 | Westhoff et al. | 198/864 X |
| 4,376,594 | 3/1983 | Prosenz | 404/6 |
| 4,474,503 | 10/1984 | Booth et al. | 404/6 |
| 4,500,225 | 2/1985 | Quittner | 404/6 |

FOREIGN PATENT DOCUMENTS

| | | | |
|---|---|---|---|
| 1179861 | 10/1964 | Fed. Rep. of Germany | 198/309 |

*Primary Examiner*—James A. Leppink
*Assistant Examiner*—John F. Letchford
*Attorney, Agent, or Firm*—Phillips, Moore, Lempio & Finley

[57] ABSTRACT

A transferable roadway lane dividers which consist of individual sections hingedly joined together. The lane dividers are picked up from one side of the lane by a transfer device mounted beneath a vehicle or trailer, travelling along the center of the lane, and are slid along the transfer device and one continuously deposited on the roadway at the desired new position on the other side of the lane.

14 Claims, 4 Drawing Figures

TRANSFERABLE ROADWAY LANE DIVIDER

CROSS-REFERENCE TO RELATED APPLICATION

This application is a continuation of U.S. patent application Ser. No. 344,755, now abandoned, filed on Feb. 1, 1982, and claiming priority under Australian Application Ser. No. PE 7491, filed on June 2, 1981.

TECHNICAL FIELD

The present invention relates to a system of transferable roadway lane dividers and a method of transferring said dividers. Such a system is necessary due to the flapping of roadways on bridges and major roads during peak hours.

BACKGROUND ART

The existing method of moving lane markers consists of manually picking up the originally placed markers and manually placing the markers into the new positions. This particular job is somewhat dangerous for the people physically moving the lanes and also requires several people to successfully carry out the operation. Another method and apparatus for moving lane markers or dividers is disclosed in U.S. Pat. No. 3,958,890 wherein hoist cables, suspended from cross-beams mounted above a roadway, are adapted to lift and move cement divider sections across a roadway. U.S. Pat. No. 4,017,200 discloses still another apparatus and method wherein a mobile apparatus has ramps for engaging under a plurality of upstanding channel members for transferring them on a roadway. The above prior art methods and apparatus have numerous deficiencies, well known to those skilled in the arts relating hereto. The present invention overcomes these problems by providing a transferable lane divider which can be moved by an appropriate transfer mechanism located on a special vehicle.

DISCLOSURE OF INVENTION

In one broad form the invention comprises a transferable roadway lane divider comprising divider sections which are adapted to be hingedly connected to adjacent sections to form a divider separating traffic lanes, said sections each having means whereby they can be picked up by a transfer device and slid along the transfer device to be repositioned.

In another form the invention comprises a method of transferring road lane dividers which dividers comprise a plurality of individual sections pivotally joined together, said method comprising the steps of lifting at least one of said sections and feeding said sections along an elongated transfer device and depositing said lane divider sections in their new position.

Another aspect of this invention relates to a mobile transfer apparatus for carrying forth the above method.

BRIEF DESCRIPTION OF THE DRAWINGS

The invention will now be described by way of example with reference to the accompanying drawings in which.

BEST MODE OF CARRYING OUT THE INVENTION

Each lane divider is made up of individual sections 1 which are hingedly joined together by connecting means, shown in the form of links 2. The required number of sections 1 are thus closely joined together in tandem relationship to form any suitable length of divider with each end containing a shaped section having only one hinge attachment and a substantially bullet shaped other end.

Figure 1:
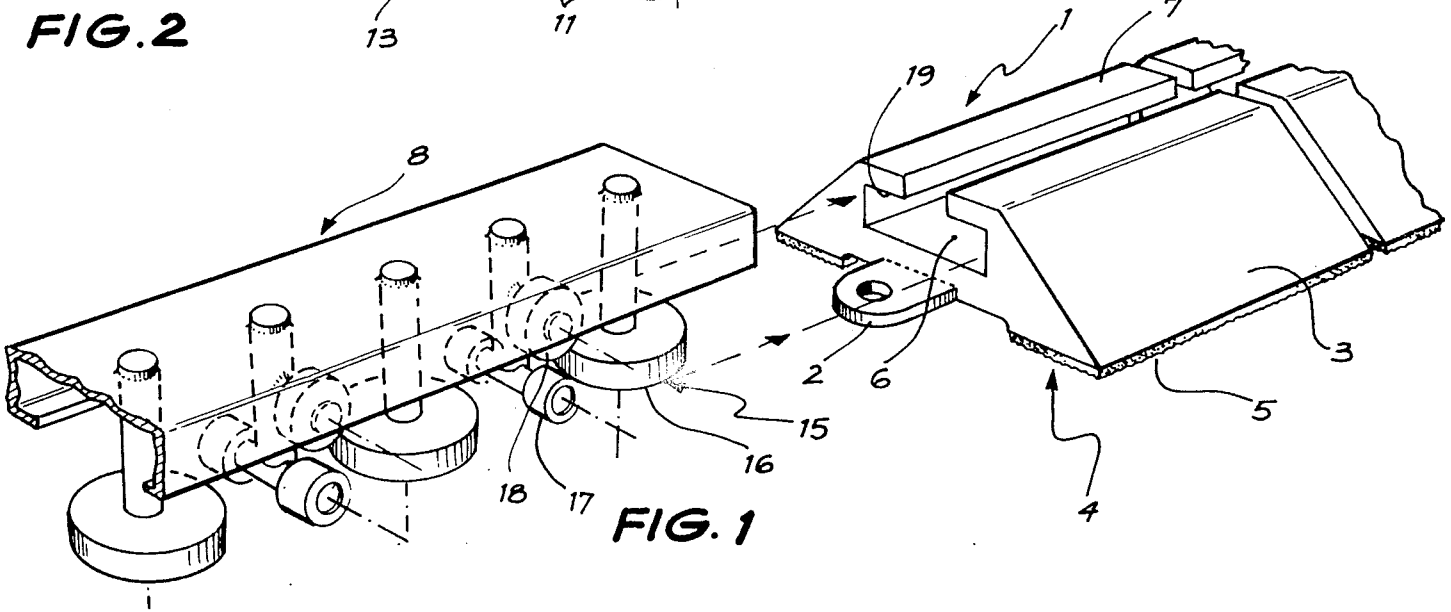
FIG. 1 shows the lead divider section and adjacent section of a embodiment of the present invention and the position of the lead in end of a transfer device of an embodiment of the present invention.

The free-standing divider sections 1 can be shaped as shown in FIG. 1 in which each section has two chamfered edges 3 to provide a smooth surface in case a motorist's tire accidentally runs onto the divider. It is desirable that the height of the divider be relatively short while using a wide base 4 to provide a solid large surface area of contact with the roadway, so as to resist lateral movement of the divider if accidentally bumped by a vehicle. Moulded shoes 5, made from any suitable material, such as polyurethane are secured on the generally flat bottom surface of base 4, to further enhance road holding.

The sections of the lane divider can be made of any suitable material such as concrete or plastics or sheet metal.

Figure 4:
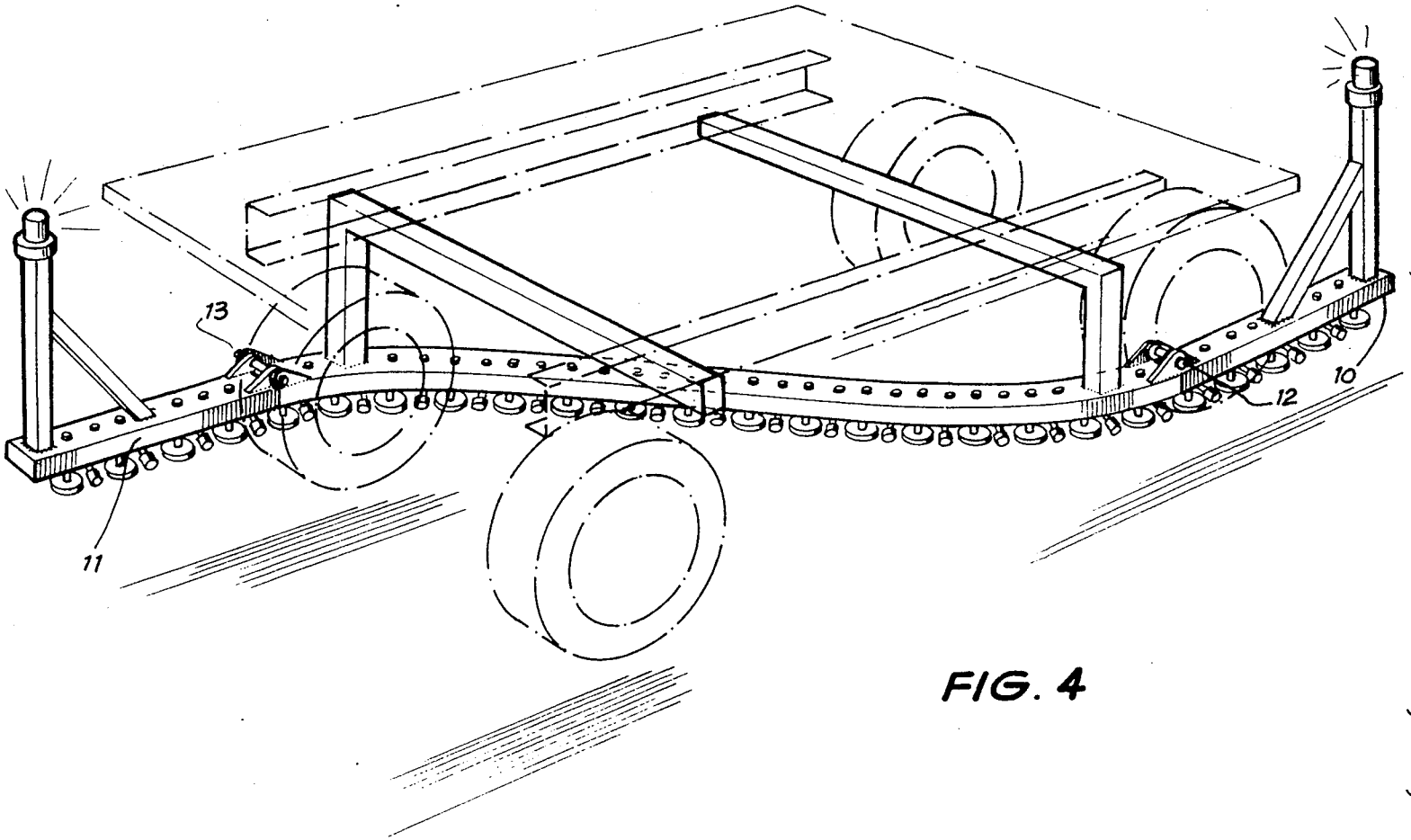
FIG. 4 illustrates schematically the position of a transfer device mounted on a trailer, according to an embodiment of the present invention.

To facilitate in moving the lane divider, each section has an inverted T-shaped cross-section channel 6 running longitudinal along the upper face 7. To transfer the lane divider, a transfer mechanism as shown in FIG. 4 can be used. This consists of a roller conveyor 8 comprising a series of rollers as shown in FIG. 1.

Figure 2:
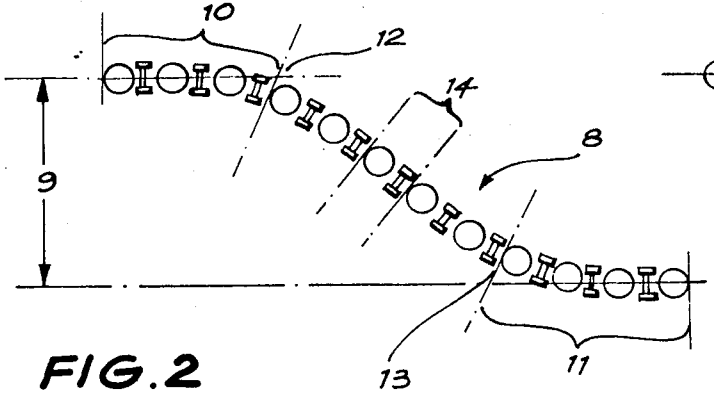
FIG. 2 shows a schematic representation of the roller assembly of one embodiment of the transfer device.

Basically the transfer mechanism is s-shaped as shown schematically in FIG. 2 with its total width 9 corresponding with the distance between traffic lanes. It can preferably be mounted, as shown schematically in FIG. 4, from below a frame of a trailer. The front section 10 and the rear section 11 are preferably hinged at pivots 12 and 13 such that they can hinge back to the body of the trailer to keep within the allowable width for travel on the road. The straight centre section 14 can be telescoped in and out to achieve variable lane widths.

To move the lane divider from one side of the lane to the other, one simply drives a mobile road vehicle with the transfer mechanism mounted beneath or towed behind on a trailer, and engages the leading rollers 15 within the T-shaped channel 6 at a first position adjacent to a first end and a first lateral side of the transfer mechanism. As the transfer mechanism is moved along the lane the lane dividers are lifted, suspended and threaded serpentine-like along the roller conveyor 8 and are deposited by the rear section 11 at a second position on the other side of the lane adjacent to a second end and a second lateral side of the transfer mechanism. Three types of rollers are used for the roller conveyor to facilitate the movement of the sections along the rollers. These are the guide rollers 16 which engage within the cross arm of the T-shaped channel, lift rollers 17 which lift the sections off the road by engaging beneath and horizontally disposed undercut bearing surfaces 19 and restraining rollers 18 which stabilize the transfer. As shown in FIG. 1, bearing surfaces 19 are formed on the undersides of a pair of laterally spaced and horizontally aligned flanges, extending longitudinally throughout the entire length of divider section 1, to provide transfer means for receiving and engaging rollers 17 thereunder.

Preferably the vehicle or trailer carries the channel underneath the wheels with the mouth extending on one side of the vehicle with the outlet extending on the other side of the vehicle such that the vehicle can drive the center of the lane to reposition the lane divider. However in certain circumstances it may be necessary for the channel to be positioned in other relationships with respect to the vehicle.

Figure 3:
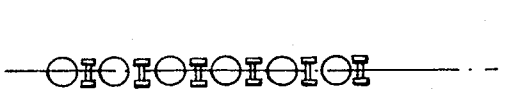
FIG. 3 shows schematic representation of the roller assembly of an aligning device for straightening up the lane dividers if they are accidentally knocked out of position.

FIG. 3 shows an aligning mechanism useable to straighten out the lane divider in cases where the lane divider is accidentally knocked out of position by a vehicle or other circumstances.

It should be apparent to people skilled in the art that the invention is not only limited to the specific disclosure detailed herein but is broad enough to cover obvious variations without departing from the spirit of the invention.

I claim:

1. A method for transferring a roadway lane divider from a first position to a laterally displaced second position on a roadway or the like, said lane divider comprising a plurality of interconnected divider sections positioned in free-standing relationship on said roadway and disposed in closely spaced tandem relationship relative to each other, comprising the steps of positioning a mobile road vehicle having a transfer mechanism adjacent to a first end of said lane divider and into engagement with divider sections thereof, moving said transfer mechanism from the first end of said lane divider towards a second end thereof and simultaneously lifting said divider sections as a unit in suspended and spaced relationship above said roadway from said first position adjacent to a first side of said transfer mechanism, moving said suspended divider sections as a unit serpentine-like generally transversely across said transfer mechanism from said first position towards said second position adjacent to a second side of said transfer mechanism opposite to the first side thereof, and depositing said suspended divider sections as a unit at said second position in free-standing relationship on said roadway.

2. The method of claim 1 wherein each of said lifting and moving steps comprises engaging and supporting upper ends of said divider sections in suspended relationship under said transfer mechanism.

3. The method of claim 2 wherein each said divider section has a pair of laterally spaced and longitudinally extending undercut bearing surfaces defined on an upper end thereof and wherein said engaging and supporting steps comprise moving a plurality of rollers beneath and into engagement with said bearing surfaces and gradually lifting said divider sections as a unit in suspended relationship above said roadway.

4. A transferable roadway lane divider for use with a mobile road vehicle having a transfer mechanism thereon comprising at least one upstanding divider section having a base and an upper end, and transfer means formed in unobstructed relationship longitudinally throughout the entire length of the upper end of said divider section for progressively receiving said transfer mechanism to enable said divider section to be lifted and suspended for transfer on a roadway in response to movement of said vehicle.

5. The lane divider of claim 4 further comprising connecting means on each end of said divider section for pivotally connecting said divider section to next adjacent divider sections.

6. The lane divider of claim 4 wherein said transfer means comprises a pair of laterally spaced undercut bearing surfaces defined on the upper end of said divider section to extend longitudinally throughout the entire length thereof and positioned to receive and engage said transfer mechanism thereunder.

7. The lane divider of claim 6 wherein the base of said divider section is substantially wider than the upper end thereof and wherein said bearing surfaces are defined on undersides of a pair of horizontally disposed flanges disposed in lateral alignment on the upper end of said divider section.

8. The lane divider of claim 7 wherein said divider section essentially comprises concrete and said base has an at least generally flat bottom surface constructed for surface mounting on said roadway.

9. The lane divider of claim 8 further comprising means on the bottom surface of said base for holding said divider section against skidding on said roadway.

10. The lane divider of claim 4 or 6 comprising a plurality of said divider sections disposed in closely spaced and tandem relationship relative to each other and connecting means for interconnecting each adjacent pair of divider sections together for permitting them to pivot laterally relative to each other and to maintain the transfer means of said divider sections in alignment to permit them to be lifted and moved serpentine-like as a unit above and across said roadway by said transfer mechanism.

11. The lane divider of claim 10 further comprising a mobile road vehicle having a transfer mechanism comprising a generally S-shaped conveyor means for sequentially engaging the transfer means of said divider sections to lift and suspend said divider sections as a unit above said roadway at a first position adjacent to a first end and a first lateral side of said transfer mechanism, move said suspended divider sections as a unit serpentine-like generally transversely from said first position to a second position adjacent to a second end and a second lateral side of said transfer mechanism, opposite to said first lateral side, and deposit said divider sections as a unit on said roadway.

12. The lane divider of claim 11 wherein said conveyor means comprises a generally S-shaped support member extending from said first position to said second position and a plurality of roller means mounted on said support member for engaging beneath the transfer means of each of said divider sections.

13. A mobile road vehicle comprising a frame, a plurality of roadwheels mounted on said frame, and means mounted on said frame for transferring a roadway lane divider from a first position on a roadway to a laterally displaced second position thereon, said lane divider comprising a plurality of interconnected divider sections positioned in free-standing relationship on said roadway and disposed in closely spaced and tandem relationship relative to each other, said means comprising a generally S-shaped conveyor means mounted on said frame for lifting and suspending said divider sections as a unit above said roadway at said first position, moving said suspended divider sections as a unit serpentine-like generally transversely across said frame from said first position towards said second position, and depositing said suspended divider sections as a unit at said second position in free-standing relationship on said roadway.

14. The vehicle of claim 13 wherein each of said divider sections has a pair of laterally spaced and longitudinally extending undercut bearing surfaces defined on an upper end thereof and said conveyor means comprises a generally S-shaped support member extending from said first position to said second position and a plurality of roller means mounted on said support member for engaging beneath said bearing surfaces for gradually lifting said divider sections as a unit in suspended relationship beneath said frame.

* * * * *